United States Patent [19]

Droste et al.

[11] Patent Number: 4,850,050

[45] Date of Patent: Jul. 25, 1989

[54] BODY ARMOR

[75] Inventors: Reinhard Droste; Dieter Kaiser, both of Wuppertal, Fed. Rep. of Germany

[73] Assignee: Akzo N.V., Arnhem, Netherlands

[21] Appl. No.: 220,342

[22] Filed: Jul. 14, 1988

Related U.S. Application Data

[63] Continuation of Ser. No. 26,372, Mar. 16, 1987, abandoned.

[30] Foreign Application Priority Data

Mar. 18, 1986 [DE] Fed. Rep. of Germany ... 8607408[U]

[51] Int. Cl.[4] ..... F41H 1/02

[52] U.S. Cl. ..... 2/2.5

[58] Field of Search ..... 2/2.5

[56] References Cited

U.S. PATENT DOCUMENTS 3,869,429 3/1975 Blades .
3,891,996 7/1975 Leach ..... 2/2.5
4,181,768 1/1980 Severin ..... 428/252

FOREIGN PATENT DOCUMENTS 0055190 6/1982 European Pat. Off. .
0138011 4/1985 European Pat. Off. .
2431674 2/1980 France .

OTHER PUBLICATIONS

Melliand Textilberichte, No. 6, pp. 463–468 (1981), "Construction and Action of Bullet Resistant Vests".
"Performance Specification for Splinter-Protective Vests of the German Army", (date unknown).

*Primary Examiner*—Werner H. Schroeder
*Assistant Examiner*—Sara M. Current
*Attorney, Agent, or Firm*—Oliff & Berridge

[57] ABSTRACT

Body armor comprising a plurality of laminated fabric layers from aramid yarn, wherein the filaments of the aramid yarn have an individual titer of less than 1.5 dtex.

5 Claims, 1 Drawing Sheet

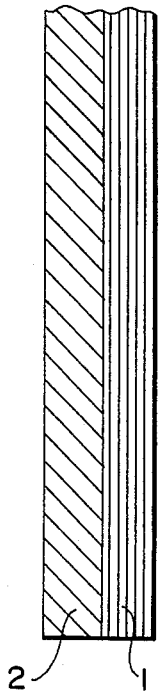
2
1

BODY ARMOR

This is a continuation of application Ser. No. 26,372 filed Mar. 16, 1987, now abandoned.

FIELD OF THE INVENTION

The invention relates to body armor comprising a plurality of laminated fabric layers from aramid yarn.

BACKGROUND OF THE INVENTION

This type of protective vests is known, for example, from Melliand Textilberichte, No. 6, pages 463–468 (1981), in which it is pointed out that fabrics from fine aramid yarns (e.g., 220 or 440 dtex), afford better ballistic protection than fabrics from relatively coarse yarns. Because of the high costs of fine yarns, a fineness of 1100 dtex is generally used and, in order to offset the somewhat poorer ballistic properties, an increase in the total-area weight would have to be accepted. These titer data all refer to the total titer of the aramid yarns used.

It may be concluded from this literature reference that, the mass per unit area of all the layers of aramid fabrics employed being equal, the ballistic protection can be increased by reducing the total titer of the aramid yarns used or that, in order to afford the same ballistic protection by reducing the total titer of the aramid yarns employed, the total-area weight can be reduced and thereby the wearing comfort can be improved.

As a rule, the filaments of aramid yarns known heretofore have an individual titer between 1.61 dtex and 1.68 dtex. Recently, an aramid yarn also became known whose filaments have an individual titer of 1.58 dtex and which is used in ballistic laminates in combination with other yarns (U.S. Pat. No. 4,181,768). However, the ballistic properties of ballistic laminates and ballistic multi-layer fabrics cannot be compared with each other.

SUMMARY OF THE INVENTION

The invention has as an object the provision of a new body armor comprising a plurality of laminated fabric layers from aramid yarn in which the ballistic protection, with equal total-area weight of the fabric layers from aramid yarn, can be increased or in which, with equal ballistic protection, the total-area weight can be reduced and thereby the wearing comfort improved.

According to the invention, this object can be achieved by imparting to the filaments of the aramid yarn an individual titer of less than 1.5, preferably 0.8 to 1.4, dtex.

BRIEF DESCRIPTION OF THE DRAWING

The drawing depicts a cross-section of an article of body armor according to the invention.

DETAILED DESCRIPTION OF PREFERRED EMBODIMENTS OF THE INVENTION

Preferred embodiments of the invention will now be described with reference to the accompanying drawing. In outer appearance, the body armor can be fashioned after body armors of the prior art (not shown), for instance in the form of a vest or jacket. Between the materials visible from the outside, the body armor is comprised of a plurality of fabric layers 1 from aramid yarns which can be bound to each other (e.g., by sewing). In order to prevent the so-called traumatic effect, a shock absorber 2 may be provided on the body side of the body armor such as that used by police. A shock absorber can be dispensed with in splinter-protective body armors such as are used by the military.

According to the invention, it has been found that the ballistic effect is improved considerably by the use of aramid yarns whose filaments have an individual titer of less than 1.5 dtex, preferably 0.8 to 1.4 dtex, for making the fabric layers 1. 1.46 dtex, 1.12 dtex and 0.84 dtex have been found to be favorable individual titers of the filaments of aramid yarn for use in the subject body armor. The objects of the invention are achieved particulary well if, in addition, the total titer of the yarns is reduced to less than 1100, preferably less than 850, dtex.

EXAMPLE

Two fabrics were made which had the following features:

| | Fabric A (comparison fabric) | Fabric B (fabric acc. to invention) |
|---|---|---|
| Warp and woof yarn | 840 dtex f 500 Aramid untwisted | 840 dtex f 750 Aramid untwisted |
| Individual titer | 1.68 dtex | 1.12 dtex |
| Fabric construction | L 1/1 | L 1/1 |
| Fabric density | | |
| Warp | 13 Fd/cm | 13 Fd/cm |
| Woof | 12.5 Fd/cm | 12.5 Fd/cm |
| Fabric weight | 220 g/m$^2$ | 220 g/m$^2$ |
| Fabric width | 120 cm | 120 cm |

Both fabrics were washed and made water-repellent, using the same formulation.

Fourteen layers of each fabric were lockstitched at the edges and shot at as described in the "Performance Specification for Splinter-Protective Vests of the German Army", Nov. 5, 1986.

For the fabric packet from Fabric A (comparison), an average $V_{50}$ value (measured) of 458 m/sec was determined, while the fabric packet from Fabric B (of the invention) yielded an average $V_{50}$ value (measured) of 480 m/sec, which corresponds to an increase of about 5%.

What is claimed is:

1. A body armor comprising a plurality of laminated fabric layers made from aramid yarns comprised of filaments, wherein the filaments of the aramid yarns have an individual titer of less than 1.5 dtex.

2. The body armor of claim 1, wherein the filaments of the aramid yarns have an individual titer of 0.8 to 1.4 dtex.

3. The body armor of claim 1, wherein the filaments of the aramid yarns have an individual titer of 1.46 dtex.

4. The body armor of claim 1, wherein the filaments of the aramid yarns have an individual titer of 1.12 dtex.

5. The body armor of claim 1, wherein the filaments of the aramid yarns have an individual titer of 0.84 dtex.

* * * * *